United States Patent [19]

Beurdeley et al.

[11] Patent Number: 4,767,900

[45] Date of Patent: Aug. 30, 1988

[54] ELECTRIC APPARATUS WITH A MANUAL CONTROL SWITCH WITH INDICATION OF THE "ON" AND "OFF" POSITIONS

[75] Inventors: Dominique Beurdeley, Dijon; Lucien Sauthier, Moissey, both of France

[73] Assignee: La Telemecanique Electrique, France

[21] Appl. No.: 87,935

[22] Filed: Aug. 21, 1987

[30] Foreign Application Priority Data

Aug. 27, 1986 [FR] France ..... 86 12114

[51] Int. Cl.[4] ..... H01H 9/16

[52] U.S. Cl. ..... 200/308; 200/339

[58] Field of Search ..... 200/308, 315, 313, 339, 200/310, 11 TW

[56] References Cited

U.S. PATENT DOCUMENTS

| | | | |
|---|---|---|---|
| 2,192,586 | 3/1940 | Getchell | 200/308 |
| 2,737,557 | 3/1956 | Johnson | 200/315 |
| 3,309,485 | 3/1967 | Gluck | 200/313 |
| 3,646,958 | 3/1972 | Braas | 200/308 |
| 4,319,107 | 3/1982 | Haskins | 200/303 |

*Primary Examiner*—Renee S. Luebke

*Attorney, Agent, or Firm*—William A. Drucker

[57] ABSTRACT

An electric apparatus is provided with a manual control switch with indication of the "on" and "off" positions, the case of said apparatus having on a front face a pivoting manual control switch capable of occupying two endmost "on" and "off" positions, said switch being mounted on a shaft provided in the case. The switch is pierced with two openings which, by a contrast between the colors of the switch and of the underlying shaft, stand out against the shaft, one of rectilinear shape indicating "on" position and the other of circular shape indicating the "off" position.

2 Claims, 2 Drawing Sheets

ELECTRIC APPARATUS WITH A MANUAL CONTROL SWITCH WITH INDICATION OF THE "ON" AND "OFF" POSITIONS

BACKGROUND OF THE INVENTION

The present invention relates to an electric apparatus including a case with, on its front face, a manual control switch movable between two end "on" and "off" positions and having two standardized position indications seen one by one by the user, one designating the "on" position and named hereafter indication "I", having the form of a vertical dash and the other designating the "off" position and named hereafter indication "O", with the form of a circle.

For this type of electric apparatus with manual control switch bearing the indications "I" and "O", such for example as a modular circuit breaker in a molded case, it is known to form the switch by molding it in the form of a button which is mounted for pivoting on a pin which is fixed with respect to the case of the circuit breaker and which is provided with a gripping projection on each side of which the two indications are situated; by pivoting, the button passes from the "on" position (closure of the circuit breaker) in which only the indication "I" appears to the "off" position (opening of the circuit breaker) in which only the indication "O" appears and vice versa.

Different methods are known for providing the indications "I" and "O" carried by the manual control switch of an electric apparatus, particularly a circuit breaker in a molded case. One consists in marking the two symbols by stamping on each side of the manual grip of the switch. This method is however time wasting, costly and always results in rejects; in addition, reversal of the two marks on the switch is always possible; also, two marks may be obliterated.

Another method consists in forming the switch with two projections forming the two symbols considered by double molding; however, such molding has a relatively long cycle time and is of a high cost.

The purpose of the present invention is to overcome all these drawbacks and to form in a simple and inexpensive way the two standardized indications "I" and "O" of the manual control switch of an electric apparatus, by making them indelible and visible on the apparatus.

SUMMARY OF THE INVENTION

For this, in accordance with the invention, an electric apparatus having a case with a front face provided with a manual control switch able to be moved between two end "on" and "off" positions, the switch extending so as to overlap a support element which is fixed with respect to the case and having on its front face two position indications one of which is a vertical line indicating the "on" position and the other is a circle indicating the "stop" position, the two indications being placed with respect to each other so that only a single one of them appears after movement of the switch from one position to the other, is characterized in that the switch and the support element are of contrasting colors and the switch is pierced with two openings through each of which the underlying support element appears and which each stand out from the support element by contrast of said colors, one of the openings being rectilinear and forming the indication of the "on" position and the other opening being circular and forming the indication of the "off" position.

Preferably, the two rectilinear and circular openings formed in the switch are integrally molded therewith. With this particularly simple construction of the two indications "I" and "O" of the switch, a significant reduction in the overall manufacturing cost of the electric apparatus advantageously results.

BRIEF DESCRIPTION OF THE DRAWINGS

Other features and advantages of the invention will be better understood from the following detailed description with reference to the accompanying drawings given solely by way of example and in which.

DESCRIPTION OF THE PREFERRED EMBODIMENT

Figure 1:
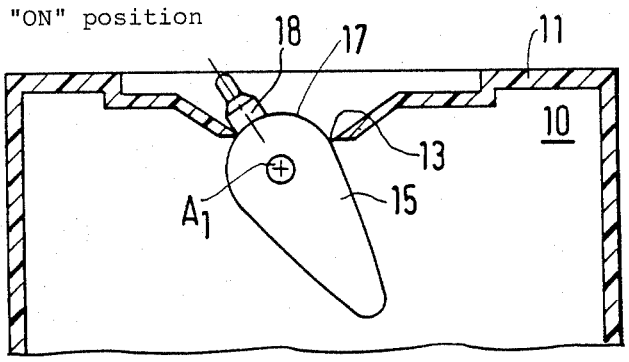
FIGS. 1 and 2 show schematically, in elevation, a part of an electric apparatus case with a manual control switch in the "on" and respectively "off" positions.
Figure 2:
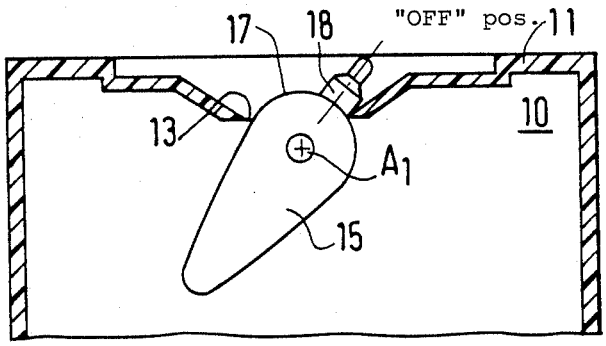

In FIGS. 1 and 2, a molded electrically insulating case 10 of an electric apparatus such for example as a circuit breaker, has on its front face 11 an aperture 13 for the free movement of a switch 15 controlling the circuit breaker manually.

Switch 15 is in the form of a pivoting button with axis $A_1$ able to occupy two end pivoting positions, namely an "on" position, FIG. 1, corresponding to closure of the circuit breaker and a symmetrical "off" position, FIG. 2, corresponding to opening of the circuit breaker. The switch is urged conventionally from one to other of its two positions by a return spring (not shown).

Except for the manual control switch, the other members which form the mechanism of the circuit breaker have not been shown in FIGS. 1 and 2 for they form no part of the invention, this latter applying moreover to any other type of electric apparatus with a manual control switch.

As shown in FIGS. 1 and 2, switch 15 has on its upper semicylindrical part 17 a manual grip 18 accessible from outside the case and capable of coming into abutment against the front face 11 of the case on each side of aperture 13 depending on the "on" and "off" positions of the switch.

Switch 15 with its grip 18 is formed as a single piece by molding an insulating material and is generally of a color different from that of case 10.

Figure 4:
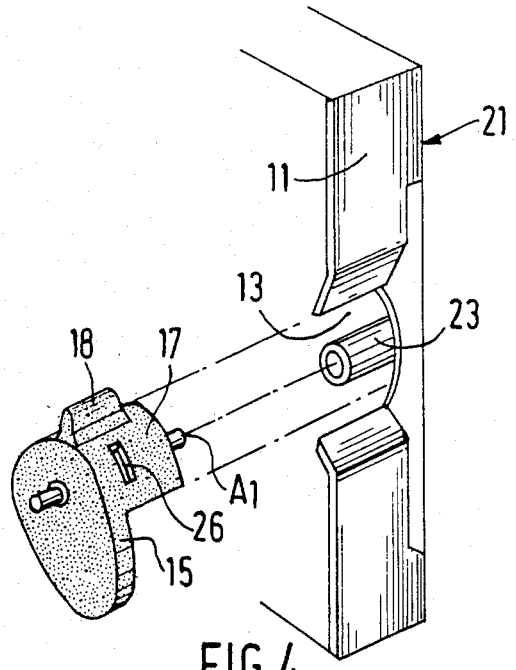
FIG. 4 shows in an exploded perspective view a part of the case and the switch in the "on" position referenced by the indication "I"
Figure 6:
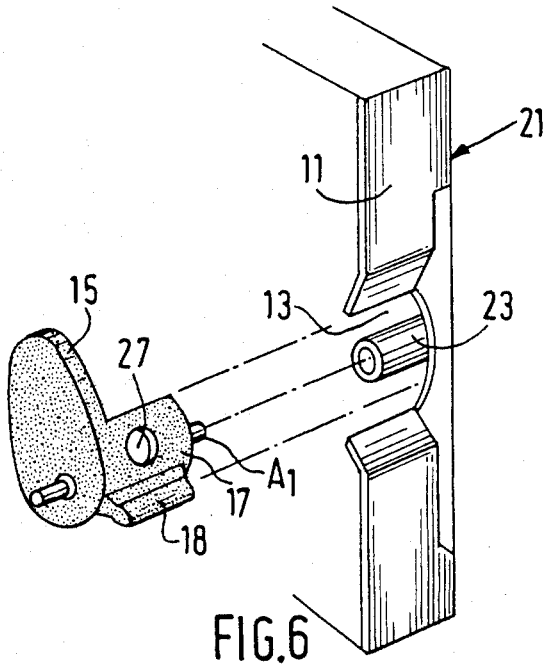
FIG. 6 shows in an exploded perspective view a part of the case and the switch in the "off" position referenced by the indication "O"

In one embodiment, case 10 is formed of two molded shells of unequal sizes which are suitably applied one against the other and assembled together by means of an appropriate fixing system; in FIGS. 4 and 6, only the front face of one of the shells is visible, designated by the general reference 21, the other shell being assumed removed.

As can be seen in FIGS. 4 and 6, shell 21 of the case has projecting transversely from its lateral face a fixed tubular shaft 23 serving as support for switch 15, this shaft extending in the middle of the aperture 13 formed in the front face 11 and receiving by engagement shaft $A_1$ carried by switch 15; during such engagement, the semicylindrical part 17 of the switch is applied over shaft 23.

It should be noted that the support shaft 23 is integrally molded with the shell 21 of the case and is of the same color as it.

Figure 3:
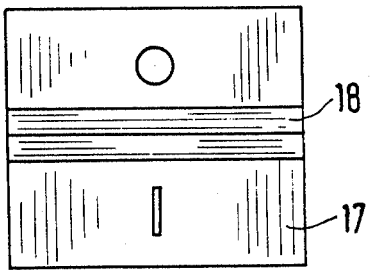
FIG. 3 shows a top view of the switch with the two indications "I" and "O"

In a way known per se, the switch carries two standardized symbols or marks for indicating the "on" and "off" positions which it may occupy: as can be seen in FIG. 3, one of the symbols is in the form of a vertical line (indication "I") identifying the "on" position, whereas the other symbol has the form of a circle (indication "O") identifying the "off" position. The two indications "I" and "O", FIG. 3, are arranged in alignment on each side of the grip 18 of the switch, so as to appear one by one when the switch passes from one position to the other.

In accordance with the invention, as shown in FIGS. 4 and 6, the two indications "I" and "O" are formed by two respectively rectilinear 26 (FIG. 4) and circular 27 (FIG. 6) openings formed in part 17 of switch 15 and through each of which the underlying shaft 23 appears supporting the switch; by choosing for switch 15 and shaft 23 respective colors which contrast with each other, the rectilinear 26 and circular 27 openings stand out one by one against shaft 23 by constrast of the colors, thus indicating very visibly to the user the "on" or "off" position which the switch occupies.

By way of non limitative example, switch 15 is a gray color, whereas the support shaft 23, that is to say in fact the case with which it is integrally molded, is of a black color.

Advantageously, the two recilinear 26 and circular 27 openings are integrally molded with switch 15; they may also be formed by cut outs in the switch.

It should be noted that the shaft 23 supporting the switch has a diameter such that the whole semicylindrical portion 17 of switch 15 rests on this shaft 23, so that each of the two openings 26, 27 stands out as a whole with respect to shaft 23.

Figure 5:
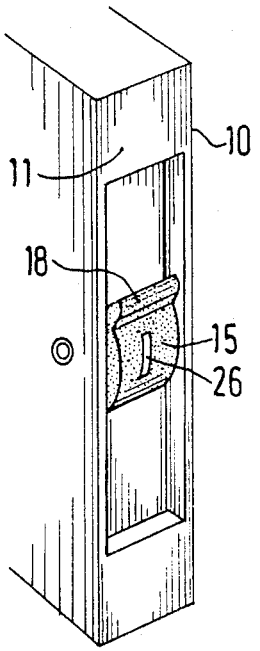
FIG. 5 shows in a perspective view a part of the case with the switch in the "on" position of FIG. 4.
Figure 7:
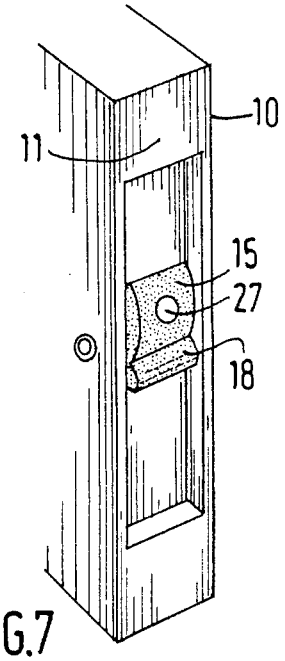
FIG. 7 shows in perspective a part of the case with the switch in the "off" position of FIG. 6.

In FIG. 5, the molded case 10 has been illustrated with switch 15 occupying the "on" position in which the rectilinear opening 26 is visible by contrast of the colors, the circular opening being hidden by the front face of the case. Similarly, FIG. 7 shows the switch 15 in the "off" position marked by the circular opening 27 which stands out by contrast, the rectilinear opening is hidden by the front face of case 10.

Thus, in the case of a switch mounted for pivoting on a shaft provided in the case, the invention takes advantage of this shaft as background against which each opening formed in the switch stands out.

Of course, the invention also applies to a switch in the form of a pusher or slider movable in translation between two endmost "on" and "off" positions; in this case, a fixed flat support is provided in the case, of a color constrasting with that of the switch, on which the switch overlappingly extends pierced with two rectilinear and circular openings, so as to obtain the desired contrast effect.

What is claimed is:

1. An electric apparatus having a case with a front face provided with a manual control switch capable of being moved between first and second endmost "on" and "off" positions, said switch extending overlappingly on a support element which is fixed with respect to the case, said switch having a first position mark comprising a vertical rectilinear opening indicating the "on" position and a second position mark comprising a circular opening indicating the "off" position, said first and second position marks being positioned with respect to each other so that a single one of them appears in each of said first and second positions of the switch, said switch and said support element being of contrasting colors and the underlying support element appearing through each of said first and second openings, said support element being formed by a shaft provided in said case and said control switch being in the form of a rocker actuator mounted for pivoting about said shaft, said shaft having such a diameter that each of the first and second openings stands out entirely against said shaft respectively when the control switch is in the first and second respective positions.

2. The electric apparatus as claimed in claim 1, wherein said case and said support shaft are of the same color and are formed as a single piece by molding an insulating material.

* * * * *